US005544633A

United States Patent [19]

Mottier et al.

[11] Patent Number: 5,544,633

[45] Date of Patent: Aug. 13, 1996

[54] MAGNETO WITH DUAL MODE OPERATION

[75] Inventors: Bradley D. Mottier; J. Norman MacLeod, both of Jacksonville; Dean Mechlowitz, Ponte Vedra Beach; Randy Erickson, Jacksonville, all of Fla.

[73] Assignee: Unison Industries Limited Partnership, Jacksonville, Fla.

[21] Appl. No.: 281,492

[22] Filed: Jul. 27, 1994

Related U.S. Application Data

[63] Continuation-in-part of Ser. No. 263,458, Jun. 22, 1994.

[51] Int. Cl.[6] ..... F02P 1/00; F02P 5/15; F02P 15/02

[52] U.S. Cl. ..... 123/310; 123/417; 123/630; 123/640

[58] Field of Search ..... 123/310, 595, 123/630, 638, 640, 641

[56] References Cited

U.S. PATENT DOCUMENTS

| | | | |
|---|---|---|---|
| 957,270 | 5/1910 | Studnicka et al. | 123/640 |
| 1,015,089 | 1/1912 | Seele | 123/640 |
| 1,074,416 | 9/1913 | Dinkins et al. | 123/149 R |
| 1,074,724 | 10/1913 | LePontois | 315/119 |
| 1,221,200 | 4/1917 | McCleneathen | 123/641 |
| 2,285,107 | 6/1942 | Bohli | 123/640 X |
| 2,371,016 | 3/1945 | Alvino | 123/640 |
| 2,481,890 | 9/1949 | Toews | 123/310 |
| 2,522,921 | 9/1950 | Barkeij | 123/309 |
| 4,069,801 | 1/1978 | Stevens | 123/640 X |
| 4,180,031 | 12/1979 | Muranaka et al. | 123/407 |
| 4,493,307 | 1/1985 | Trinh et al. | 123/630 |
| 4,611,570 | 9/1986 | Nash | 123/601 |
| 4,624,234 | 11/1986 | Koketsu et al. | 123/602 |
| 4,817,577 | 4/1989 | Dykstra | 123/651 |
| 4,858,585 | 8/1989 | Remmers | 123/602 |
| 5,320,075 | 7/1994 | Regueiro | 123/310 |
| 5,331,935 | 7/1994 | Daino | 123/640 X |

OTHER PUBLICATIONS

"Starting Vibrator Assemblies", Bendix Engine Products Division, Aug., 1978.

"The Aircraft Magneto", Bendix Engine Prodducts Division, vol. 7, (1954).

*Primary Examiner*—Tony M. Argenbright

*Attorney, Agent, or Firm*—Leydig, Voit & Mayer, Ltd.

[57] ABSTRACT

An ignition system is provided for an internal combustion engine that operates in two modes. In a first mode, the timing of the spark event is under electronic control. In a second mode, the timing of the spark event is fixed and synchronized to the mechanical rotation of the crankshaft of the engine. Under normal operating conditions, the timing of the spark event is electronically controlled. If the electrical system of the engine malfunctions, the ignition system defaults to the second mode in which ignition timing is mechanically controlled.

20 Claims, 11 Drawing Sheets

FIG. 3A
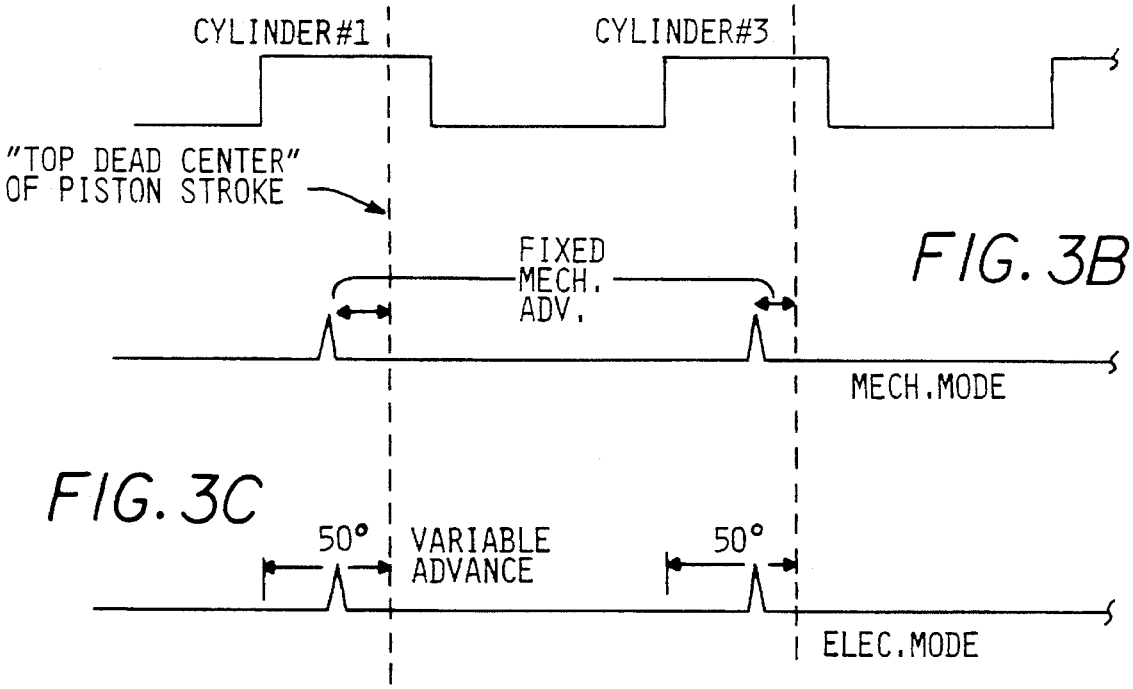
FIG. 3B
FIG. 3C
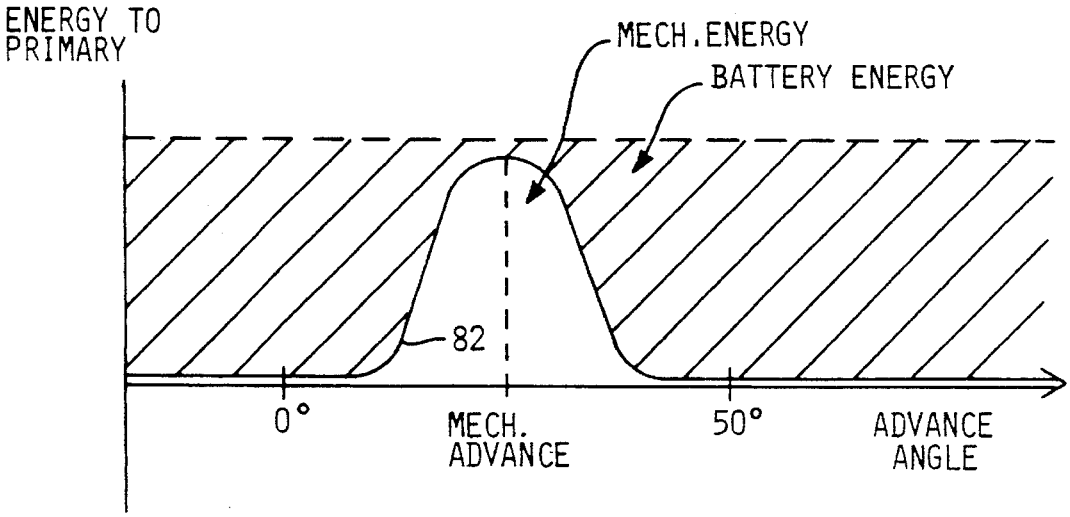
FIG. 4

MAGNETO WITH DUAL MODE OPERATION

This application is a continuation-in-part of copending U.S. application Ser. No. 08/263,458 filed Jun. 22, 1994.

TECHNICAL FIELD

The invention relates to ignition systems for internal combustion engines and, more particularly, to ignition systems for igniting fuel in reciprocating aircraft engines.

BACKGROUND OF THE INVENTION

Magneto-based ignition systems are well known and are often used with internal combustion engines in applications where batteries are not practical. Magnetos are robust devices that are typically highly reliable. As such, magneto-based ignition systems have been historically used with internal combustion engines for aircraft applications. In a typical magneto-based ignition system for an aircraft internal combustion engine, redundant ignition systems are employed for safety purposes. Also, with safety in mind, the magneto-based ignition systems for aircraft are typically mechanically timed to ensure highly reliable operation. In this connection, it is not uncommon for small aircraft to experience malfunctions of their electrical systems. Because of the obvious need to ensure high reliability of the ignition systems for internal combustion engines in aircraft applications, such ignition systems have historically avoided electronic ignition control mechanisms for advancing and retarding spark timing, even though such electrical control devices are commonly used in automotive applications.

Because magneto-based ignition systems in aircraft applications employ mechanical linkage to time the spark events, the timing of the spark event for each piston is at a fixed advance with respect to the "top-dead-center" (TDC) position of the reciprocating piston. The advance is typically selected for optimum performance under take-off conditions. Unfortunately, during different parts of a flight, the engine is operating in different conditions. Therefore, the advance and total energy of a spark event that provides the most efficient combustion and energy conversion varies during the flight. In the past, the small aircraft industry has sacrificed engine performance in order to ensure safety by maintaining the fixed mechanical advance of the spark event for all engine operating conditions. As a result of the fixed mechanical advance of the magneto-based ignition systems for small aircraft, the engines operate at less than optimum fuel economy and exhaust more pollutants.

In one example of a previous attempt to provide controlled advance timing of the spark event in a magneto-based ignition system, U.S. Pat. No. 4,624,234 to Koketsu et al. describes an electronic circuit for controlling the timing of the spark event and a mechanism for defaulting to a mechanical timing when the regulated voltage supply for the electronic circuit is inadequately regulated. In this system, however, the sole source of energy for the spark event is the rotating magnet of the magneto. Unfortunately, the power curve of the magneto is mechanically fixed and the mechanical advance for the ignition is usually selected to occur at the peak of the magneto's power curve. Therefore, changing the timing of the spark event relative to the mechanical setting results in a reduction in the energy of the spark event.

Other attempts have been made to employ both the energy from the rotating magnet of a magneto and the energy from a battery in the electrical system of the engine. For example, U.S. Pat. No. 1,074,724 discloses providing energy to the primary coil of a magneto by way of both the conventional rotating magnet of the magneto and from a battery. By appropriately synchronizing the timing of the ignition system with the rotating magnet, the patent provides for the spark event to occur only during the positive portions of the alternating positive and negative voltages impressed on the primary coil by the rotating magnet, thereby ensuring the energy from the battery complements the energy from the rotating magnet when the spark event occurs. Only conventional mechanical breaker points are used in this ignition system, resulting in a mechanically fixed ignition timing for all engine operating conditions. Therefore, over much of its operating conditions, the engine operates inefficiently.

SUMMARY OF THE INVENTION

It is a general aim of the invention to provide an ignition system for an internal combustion engine that enhances engine performance while maintaining redundancy and fail-safe operation of conventional magneto-based ignition systems.

It is a more specific object of the invention to provide an ignition system that enhances the output power of an internal combustion engine while maintaining the redundancy and fail-safe operation of a conventional magneto-based ignition system.

It is yet another object of the invention to provide an ignition system for internal combustion engines that enhances the starting reliability of the engine while maintaining redundancy and fail-safe operation of a conventional magneto-based ignition system.

It is a related object of the invention to provide an ignition system for an internal combustion engine in an aircraft that increases the fuel efficiency of the engine and reduces its emissions.

It is also an object of the invention to provide an ignition system that achieves the foregoing objectives and is also amenable to retrofit installation.

It is a further object of the invention to provide an ignition system for an internal combustion engine used in an aircraft application that interfaces with a pilot of the aircraft in the same manner as conventional ignition systems and in accordance with existing regulatory requirements.

Briefly, the ignition system according to the invention operates in a first mode having magneto and battery energy sources to electronically control the timing and total energy of each spark event and, alternatively, operates in a second mode having only the magneto energy source to provide fixed mechanical timing of the spark event as a backup and a fail-safe mode of operation in case of a failure in the electrical system of the engine. In both modes of operation, the conventional primary and secondary coils of the magneto are used to generate and discharge energy to the spark plugs of the engine. In the first mode of operating the magneto coils, a microprocessor-based controller controls the timing of the discharging of the primary coil. In response to engine condition inputs such as speed and manifold pressure, the controller either advances or retards the spark event relative to the fixed mechanical setting provided by the mechanical interconnections between the breaker points of the magneto and the engine cam shaft. If a failure in the electrical system occurs, the controller allows the magneto to default to the fixed mechanical setting provided by the mechanical interconnections between the engine and the ignition system. Moreover, a significant failure of the controller itself results in the magneto also defaulting to the fixed mechanical setting.

In aircraft applications, in order to ensure fail-safe operation, two magnetos are provided for the engine in order to provide redundancy. In keeping with the invention, the ignition system for such an engine provides dual-mode operation for both magnetos.

When the ignition system is in the first or spark advance mode, the primary coil of the magneto receives its input energy from both the rotating magnet of the magneto and the battery of the electrical system of the engine. In this connection, the power curve of the magneto itself is such that the energy output from the rotating magnet to the primary coil of the magneto is a bell-shaped curve centered at the mechanical advance provided by the breaker points of the magneto. If the rotating magnet is the only source of power to the primary coil of the magneto, advancing or retarding the spark event relative to the mechanical setting does not satisfactorily enhance engine operation since the timing of the spark event quickly moves the magneto off the peak of its power curve such that the energy provided to the spark plug is seriously compromised.

When the microprocessor-based controller advances or retards the spark event with respect to the mechanical setting as set by the magneto, the battery of the engine's electrical system supplements the decreasing power to the primary coil from the rotating magnet of the magneto. Thus, the reduction in power to the primary coil from the rotating magnet of the magneto is made up for by power from the battery. In keeping with the invention, the rotating magnet and the reciprocating pistons of the engine are synchronized so that spark events only occur during positive portions of the positive/negative energy cycle imparted to the primary coil by the rotating magnet. Such synchronization ensures the positively biased energy of the battery and the energy from the rotating magnet are complementary at the time of each spark event.

In order to alternatively place the ignition system of the invention in its spark advance mode or its fixed advance mechanical mode, a mode switch is provided that selectively connects the primary coil of the magneto to either the mechanically driven breaker points of the magneto or to a current regulator and switch controlled by the microprocessor-based controller. In the fixed advance mechanical mode, the primary coil of the magneto is set to the breaker points as is conventional in existing magnetos. The rotating magnet provides a changing electromagnetic field that transfers energy to the primary coil in a well-known manner. In response to the mechanical rotation of a cam driven by the crank shaft of the engine, the breaker points open and close in synchronized timing with the reciprocating pistons of the engine. In a manner well known in the art, the opening and closing of the breaker points causes the energy in the primary coil to transfer to the secondary coil, which in turn delivers the power to a spark plug in order to generate a spark event.

In the spark advance mode of operation, the mode switch is energized in order to disable the breaker points from controlling the primary coil. Instead of the breaker points, the coil is controlled by the current regulator and switch. More specifically, one end of the primary coil is connected to the battery and the other end of the coil is connected to ground through the current regulator and switch. By controlling the current through the primary coil, the microprocessor-based controller is able to control the total power delivered to the plug at each spark event. By controlling the timing of the switch, the controller adjusts the timing of the spark event so as to maximize engine efficiency in accordance with changing engine conditions as measured by parameters such as speed and manifold pressure.

If the electrical system of the engine experiences a malfunction and fails, the failure mode of the controller deenergizes the mode switch. Deenergizing the mode switch results in the primary coil of the magneto re-connecting to the magneto breaker points, which returns the advance angle for the spark event to its fixed mechanical setting.

Another important aspect of the invention is its ability to satisfy the existing regulatory pre-flight testing requirements in aircraft applications. In this connection, the invention provides hardware and software that is responsive to the standard three-position switch in a cockpit used by pilots to test the dual magnetos on an engine prior to flight. Specifically, the three-position switch includes a position for operating the "left" magneto, the "right" magneto, and a third position for operating both magnetos, which is the normal operating position. In accordance with existing requirements of the United States Federal Aviation Administration, the invention provides for disabling the electronic control of the spark events when the pilot switches to test either the left or right magneto. The electronic control of the spark advance returns after the lapsing of a predetermined time period when the pilot returns the switch to the position for operating both magnetos.

Because aircraft applications require dual magnetos and dual plugs for each piston, the microprocessor-based controller may enhance the effectiveness of the spark event by staggering the two spark events of the two plugs at each piston. By staggering the initiation of the spark events for the two plugs of a piston, the duration of the total spark event can be effectively extended, thus providing an additional ability to control the combustion of fuel in order to optimize engine performance. Moreover, by sensing the present values of engine parameters, the microprocessor-based controller can evaluate the operating condition of the engine and adjust the timing and energy of the spark event accordingly. For example, when the engine is started, the microprocessor-based controller may provide increased energy for each spark event in order to make starting of the engine more reliable. Once the microprocessor-based controller has sensed the engine is running, the energy can be reduced in order to ensure that long-term, high-energy spark events will not damage the engine or the plugs.

While the invention will be described in some detail with reference to a preferred embodiment, it will be understood that it is not intended to limit the invention to such detail. On the contrary, it is intended to cover all alternatives, modifications, and equivalents that fall within the spirit and scope of the invention as defined by the appended claims.

BRIEF DESCRIPTION OF THE DRAWINGS

FIGS. 3A–3C are exemplary timing diagrams illustrating the timing of a distributor (FIG. 3A), the fixed mechanical advance of a spark event provided by the conventional points of the magneto-based ignition system operating in a mechanical or "default" mode (FIG. 3B) and a variable advance/retard of the spark event provided by the controller of the ignition system operating in an electronic mode (FIG. 3C);

FIG. 4 is an exemplary graph illustrating the contributions made by mechanical and battery sources to the power delivered to a primary coil of the ignition system for various timing angles of the spark event;

DETAILED DESCRIPTION OF THE ILLUSTRATED EMBODIMENT

Figure 1:
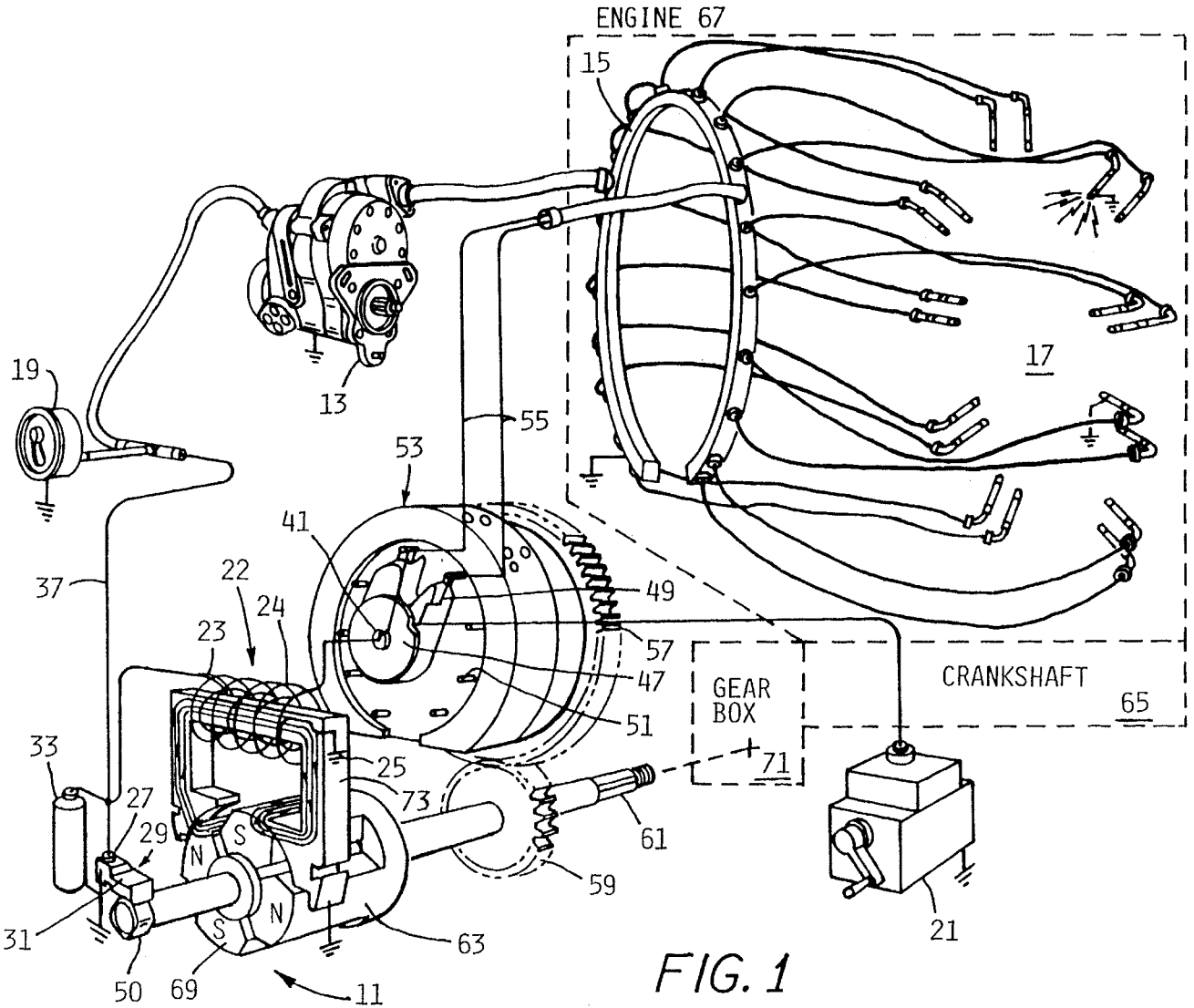
FIG. 1 is a pictorial illustration of a magneto-based ignition system according to the invention, illustrating a magneto employing a four-pole rotating magnet instead of a conventional two-pole magnet.

FIG. 1 illustrates a complete high-tension ignition system consisting of two magnetos 11 and 13, radio shield harness 15, spark plugs 17, an ignition switch 19, and a booster magneto 21. One magneto 13 is illustrated completely assembled and the other 11 is in skeleton form showing electrical and magnetic circuits. Because the two magnetos are identical only magneto 11 will be described in any detail hereinafter.

In a conventional manner, an ignition coil 22 of the magneto 11 includes primary and secondary coils 23 and 24, respectively. One end of the primary coil 23 of the magneto 11 is connected to ground 25. The other end of the primary coil 23 is connected to an insulated contact point 27 of a breaker 29. An opposing contact point 31 of the breaker 29 is connected to ground. A capacitor 33 is connected across the breaker 29 in a conventional manner.

The ignition switch 19 is electrically connected to the insulated contact point 27 by way of a wire 37. When the switch 19 is in the "off" position, the wire 37 provides a direct path to ground for the contact point 27. Therefore, when the contact points 27 and 31 are open and the switch 19 is in the "off" position, any current in the primary coil 23 is not interrupted, thus preventing the production of high voltage in a secondary winding 24 and unwanted ignition sparks.

Like the primary coil 23, one end of the secondary winding 24 is grounded to the magneto 11. The other end terminates at a high tension insert 41 to a distributor block 53. In response to a sudden change in the current through the primary coil 23, a high tension current is produced in the secondary winding 24, which is then conducted to a distributor finger 47 by means of a carbon brush (not shown). From here the high tension current is conducted to a high-tension segment 49 of the distributor finger 47 and across a small air gap to electrodes 51 of a distributor block 53. High tension cables 55 in the distributor block 53 then carry the current to the spark plugs 17 where the discharge event or spark event occurs. The distributor finger 47 is secured to the large distributor gear 57, which is driven by a smaller gear 59 located on the drive shaft 61 of a rotating magnet 63. The ratio between the two gears 57 and 59 is always such that the distributor finger 47 is driven at one-half the speed of the engine crankshaft 65. This ratio of the gears ensures proper distribution of the high-tension current to the spark plugs 17 in accordance with the firing order of the engine 67 (see FIGS. 3A through 3C).

The contact points 27 and 31 of the breaker 29, when opened, function with the capacitor 33 to interrupt the flow of current through the primary coil 23, causing an extremely rapid change in flux linkages. In less than a thousandth of a second, the flux through a horseshoe-shaped core 73 linking the primary coil 23 changes from a high positive value to a high negative value. This rapid change in the flux linkage induces several hundred volts in the primary coil 23. By way of transformer action, this high voltage induces a voltage of several thousand volts in the secondary winding 24. Because the secondary winding 24 is connected directly to one of the spark plugs 17 by way of the distributor finger 47, a high voltage at the secondary winding causes the air gap at the plug to ionize and become conductive. As the air gap becomes conductive, current starts to flow in the secondary winding 24 of the magneto 11 through the plug 17. The flow of current to the spark plug 17 creates the ignition spark.

When the high voltage in the secondary winding 24 discharges, a spark jumps across the air gap of the spark plug 17, which ignites the fuel in the cylinder. During the time it takes for the spark to completely discharge, current is flowing in the secondary winding 24. The energy in the secondary winding 24 completely dissipates and is discharged before the contact points 27 and 31 of the breaker 29 close and the next charging cycle begins. In other words, all of the electromagnetic action of the secondary winding 24 has dissipated before the points 27 and 31 close, and the magnetic circuit of the magneto 11 has returned to its normal or static condition and is ready to begin the build-up of current in the primary coil 23 for the next spark, which is produced in the same manner as the first.

A cam 50 synchronizes the opening and closing of the points 27 and 31 with the position of the reciprocating pistons in the engine 67. Typically, the cam 50 is shaped to open and close the points 27 and 31 to provide a spark at an advance angle of approximately 25 degrees from a "top-dead-center" position of the reciprocating position (see FIGS. 3A through 3C). Because the advance is mechanically fixed, it is static for all engine conditions. Accordingly, in aviation applications, the advance is usually selected to provide maximum engine power during take-off of the aircraft.

Practically all aircraft engines operate on the four-stroke cycle principle. Consequently, the number of sparks required for each complete revolution of the engine 67 is equal to one-half the number of cylinders on the engine. The number of sparks produced by each revolution of the rotating magnet 63 is equal to the number of its poles 69. Therefore, in a conventional magneto, the ratio of the speed at which the rotating magnet 63 is driven to that of the engine crankshaft 65 is always half the number of cylinders on the engine 67 divided by the number of poles 69 on the rotating magnet. In the illustrated ignition system of FIG. 1, the engine 67 has nine (9) cylinders and the rotating magnet has four (4) poles. A gearbox 71 provides a power take-off drive interfacing the drive shaft 61 of the rotating magnet 63 and the crankshaft 65 of the engine 67.

Since the number of sparks that can be produced by the rotating magnet 63 in one revolution is equal to the number of poles on the magnet, the greater the number of poles, the more sparks the magnet can produce at a certain speed of rotation. Thus, an 8-pole magneto, if used on a 14-cylinder engine is driven at ⅞ engine crankshaft speed, whereas it would be necessary to drive a 4-pole magneto at $2\times\frac{7}{8}=1-\frac{3}{4}$ times engine crankshaft speed. In the illustrated ignition system, the 4-pole magnet 63 is driven at ⅝ engine speed.

Figure 9:
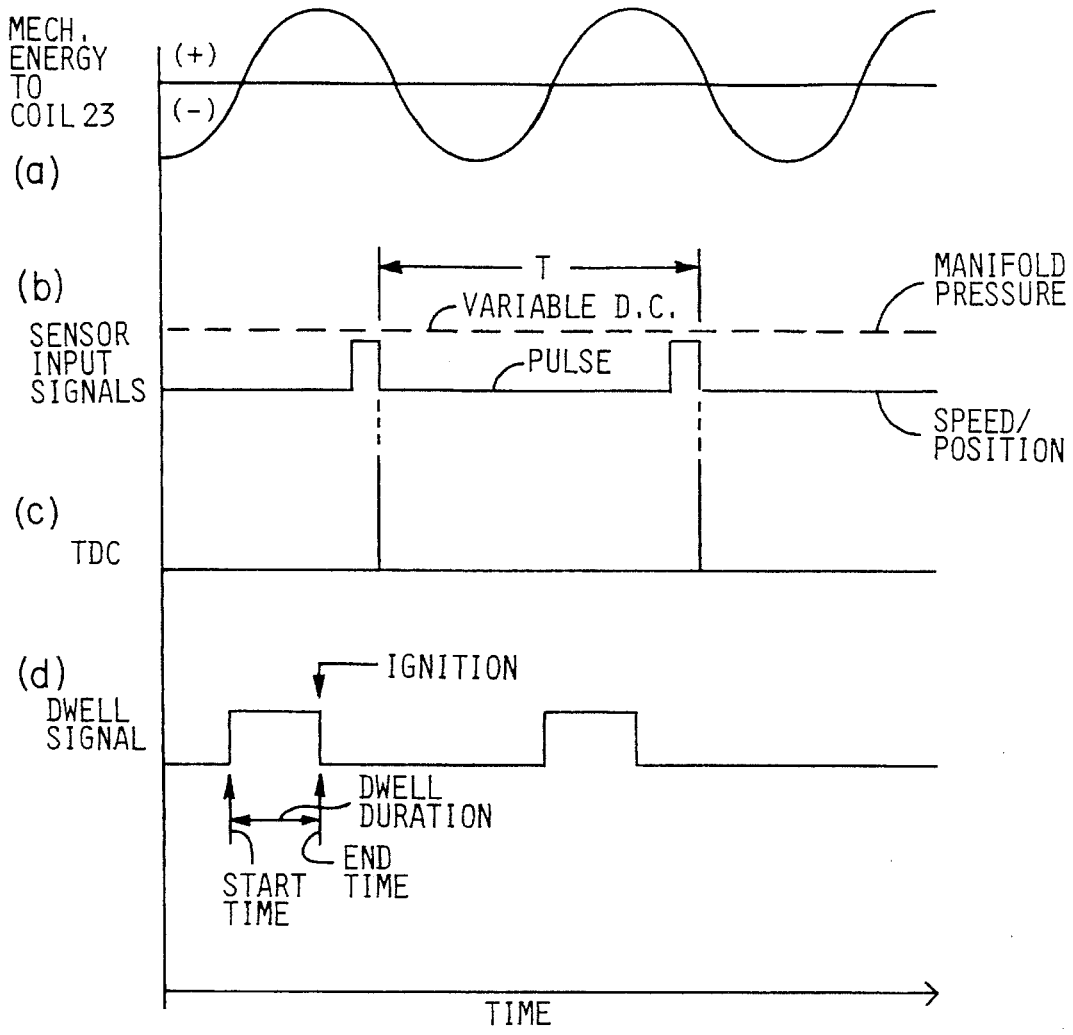
FIG. 9 is a timing diagram including exemplary and idealized waveforms (a) through (d), which illustrate various waveforms and timing parameters of the ignition system.

As it rotates, the magnet 63 imparts energy to the primary coil 23 of alternating polarity (voltage), depending on whether the pole 69 imparting the energy to the coil is a north or south pole. In the ignition system of the invention, the energy from the battery 81 is unipolar. Therefore, the bipolar energy transfer of the rotating magnet 63 must be reconciled with the unipolar energy provided by the battery 81 in order to ensure the two energy sources are additive during the time of each ignition event. Otherwise, the bipolar nature of the energy from the rotating magnet 63 may result in little or no net energy in primary coil 23 at the time of an ignition event. Waveform (a) of FIG. 9 illustrates the bipolar nature of the energy transfer from the rotating magnet 63 to the primary coil 23.

In keeping with the invention, the problem of the negative going portion of the energy transfer from the rotating magnet 63 to the primary coil 23 may be handled by simply doubling the number of poles of the rotating magnet 63 (with respect to conventional magnetos) so that each ignition event occurs during the positive portion of the energy transfer cycle from the magnet 63 to the coil 23. In general, in order for the ignition events to be in phase with only the positive portion of the energy transfer from the magnet 63, the number of poles of the magnet must be as follows:

$$\text{No. of Poles} = \frac{\text{No. of Cylinders} \times S_{crankshaft}}{S_{magnet}}$$

where $S_{crankshaft}$ and $S_{magnet}$ are the speeds of the crankshaft 65 and magnet 63, respectively.

As an alternative to doubling the number of poles of the rotating magnet 63, an "H-bridge" circuit can be interposed between the battery 81 and the primary coil 23 in order to switch the polarity of the battery's connection to the primary coil in synchronization with the bipolar energy imparted to the coil from the rotating magnet. With the use of an "H-bridge" circuit as illustrated in FIG. 13A, the number of poles 69 of the magnet 63 can remain the same as in conventional magnetos.

In the H-bridge of FIG. 13, four power transistors $T_1$ through $T_4$ are used to alternate the polarity of the battery 81 applied to the ends of the coil 23. In a well known manner, the transistors $T_1$ and $T_4$ are turned on together to apply the battery 81 to the coil 23 in one polarity. To apply the battery 81 in the other polarity, the transistors $T_2$ and $T_3$ are turned on. In an alternative embodiment in keeping with the invention, the H-bridge may be incorporated into the illustration of the ignition system in FIG. 2 as suggested by the dashed-line placement in FIG. 13 of the current regulator and switch 105 and the relay contacts 107 and 109 for mode switch 105.

Figure 13A:
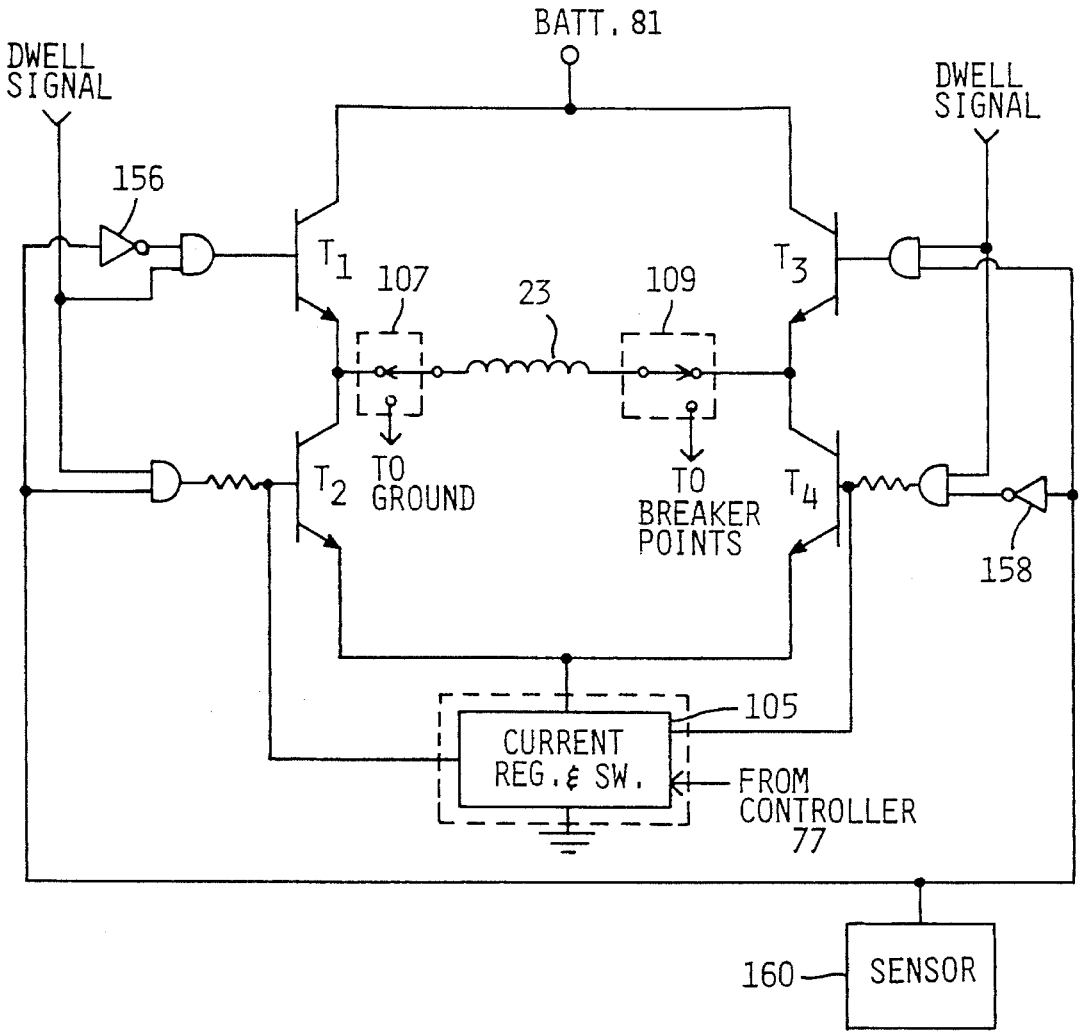
FIGS. 13A and 13B are schematic illustrations of an H-bridge circuit for periodically reversing the polarity of a connection between a battery of the engine's electrical system and a primary coil of the magneto in accordance with an alternative embodiment of the invention.
Figure 13B:
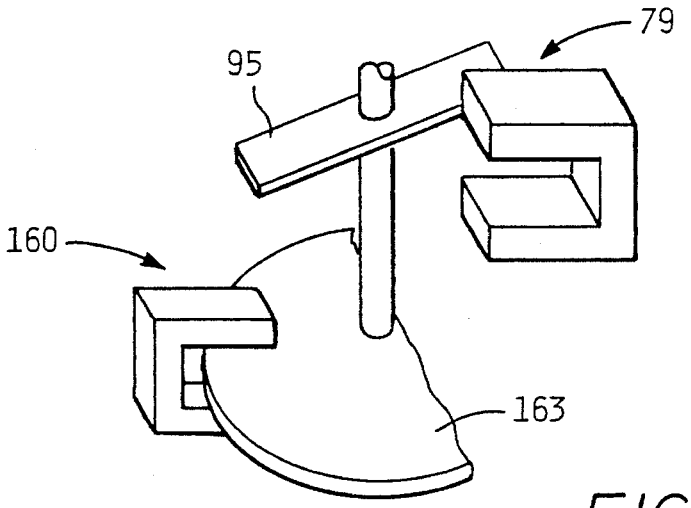

In FIGS. 13A and 13B, the drive circuit comprising inverters 156 and 158 controls which pair of the transistors $T_1$, $T_4$ and $T_2$, $T_3$ is turned on in response to a Hall effect sensor 160, which cooperates with a paddle 163 (FIG. 13B) that is carried on the shaft of the rotating magnet 63 and circumferentially spans about 180 degrees of the shaft. The paddle 163 is appropriately keyed to one of the two poles 69 of a conventional magnet (not illustrated) for the purpose of resolving either the positive or negative half cycles of the energy imparted to the coil 23 by the magnet. In general, the sensor 160 must be able to resolve the position of the north and south poles on the magnet 63. In the embodiment described above, the magnet is assumed to have only two poles. Thus, the sensor 160 needs only to resolve the rotation of the magnet into 180 degree halves, with the positively sensed 180 degree half accepted as either being always of one or the other polarity.

In a well known manner, the rotating magnet 63 induces a magnetic field whose flux is concentrated through the horseshoe-shaped core 73 of the ignition coil 43. As suggested by the lines of flux 75 illustrated in FIG. 1. The rotating magnet 63 functions as a rotor of a generator and the core 73, which is comprised of magnetically permeable material, functions as the stator of the generator. Rotation of the rotating magnetic causes the primary coil 23 of the ignition coil 43 to store energy that is discharged through the secondary coil 39 in the form of a current and voltage as described above.

Sparks are not produced until the rotating magnet 63 is turned at or above a specified number of revolutions per minute at which speed the rate of change in flux linkages is sufficiently high to induce the required primary current and the resultant high-tension output. This speed varies for different types of magnetos but the average is 100 r.p.m. This is known as the "coming-in" speed of the magneto.

When conditions make it impossible to rotate the crankshaft 65 of the engine 67 fast enough to produce the "coming-in" speed of the magneto 11, a source of external high-tension current is provided for starting purposes. This may be either in the form of a booster magneto 21 as illustrated, a high-tension coil (not shown) or an induction vibrator (not shown) to which primary current is supplied by means of a battery. In the latter case, the vibrator points in the induction vibrator serve to supply an interrupted or pulsating current to the primary coil of the ignition system. This pulsating current is stepped up by transformer action in the secondary winding of the magneto to provide the required voltage for firing the spark plug. With the vibrator points, the sparks are provided to the plug at a high frequency and asynchronously with respect to the positions of the engine pistons. This ignition mode for starting the engine is sometimes referred to as a "shower of sparks" mode.

Figure 2:
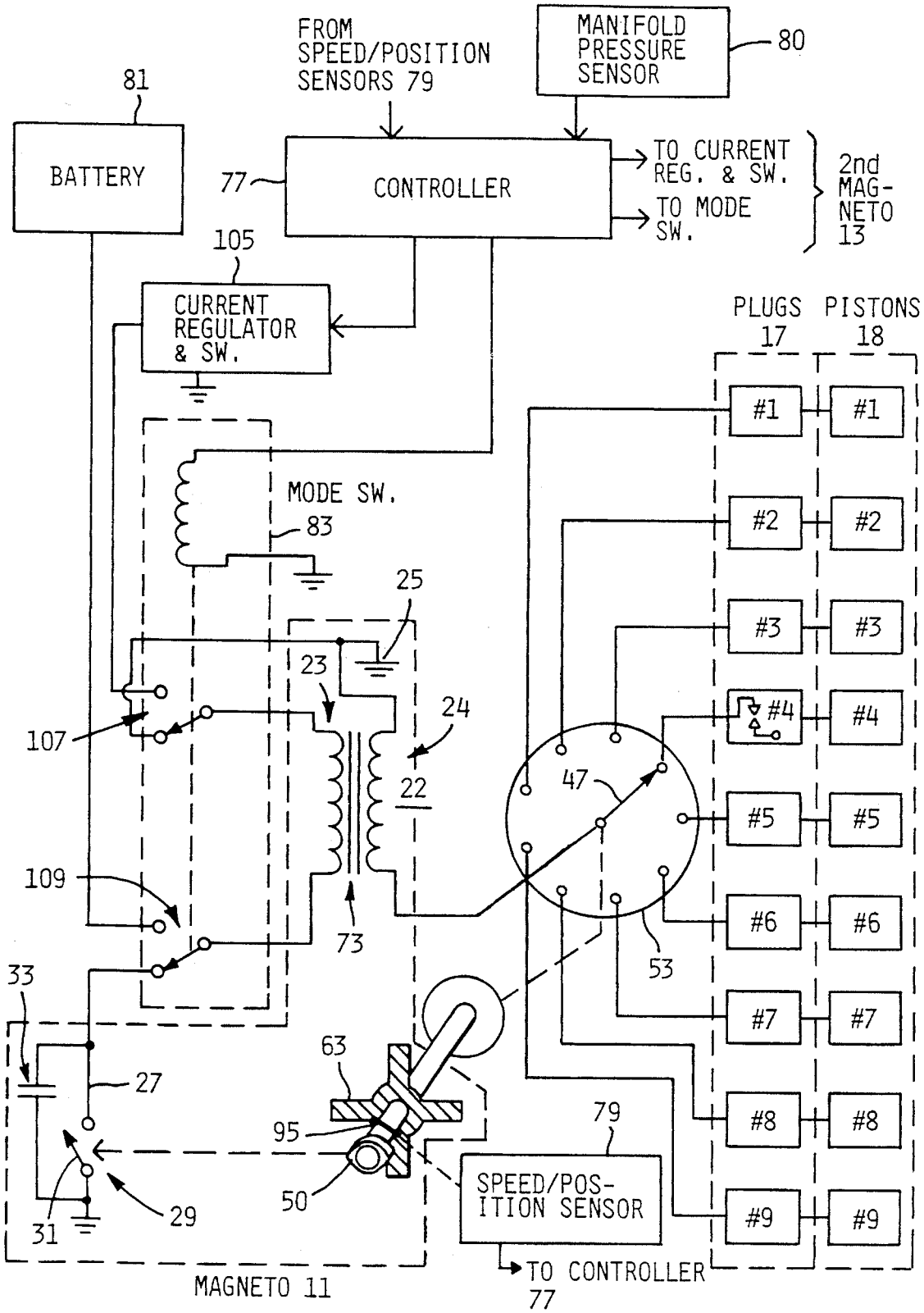
FIG. 2 is a conceptual block diagram of a magneto-based ignition system according to the invention.

Referring to FIG. 2, the magneto 11 of FIG. 1 operates in two alternative spark timing modes. In a first and primary mode, the magneto 11 is adapted to regulate the timing of each spark event at the ignition plugs 17. In order to control the timing of the spark event, the discharging of the primary coil 23 in the magneto 11 is controlled by a microprocessor-based controller 77. In response to engine condition inputs such as speed and manifold pressure sensors 79 and 80, respectively, the controller 77 either advances or retards the spark event relative to a pre-set mechanical setting provided by the conventional mechanical interconnections of the magneto to the engine crankshaft 65 as described in connection with FIG. 1.

In accordance with one important aspect of the invention, when the ignition system is in its spark advance mode, the primary coil 23 of the magneto 11 receives its input energy from both the generator action of the rotating magnet 63 of the magneto and a battery 81 of the electrical system of the engine 67. In this connection, applicants have found that the power curve for the magneto 11 alone is such that the energy delivered from the rotating magnet 63 to the primary coil 23 of the magneto is a bell-shaped curve 82 centered at the mechanical advance provided by the magneto as illustrated in FIG. 4. If the rotating magnet 63 is the only source of power to the primary coil 23 of the magneto 11, advancing or retarding the spark event by way of an electronic control, such as that provided by the microprocessor-based controller 77 of the invention, would not operate satisfactorily since advancing or retarding the spark quickly moves the magneto off the peak of its power curve as suggested by the graph of FIG. 4 such that the energy provided to one of the spark plugs 17 is seriously compromised. In order to solve the problem of the reduced energy delivery provided by the magneto 11 when the spark event is advanced or retarded with respect to the mechanical setting provided by the magneto itself, the battery 81 of the engine's electrical system also provides power to the primary coil 23 so that the reduction in the power to the primary coil from the magneto when the spark event is retarded or advanced is made up for by power from the battery and frequently is controlled to produce an overall higher energy spark than is possible with a conventional magneto.

In accordance with another important aspect of the invention, a relay 83 in the schematic diagram of FIG. 2 functions as a mode switch to alternatively switch the ignition system between its primary mode that controls the advance of the ignition timing and a "default" or "fail-safe" mode that provides for operation of the magneto in a conventional manner if the electrical system fails. In this latter mode, the advance of the spark event is set at a fixed advance angle determined by the mechanical linkage between the rotating magnet 63 of the magneto 11 and the crankshaft 65 of the engine 67 as described in connection with the magneto of FIG. 1. Those skilled in the art of electronic design will appreciate that a solid-state switch could replace the relay 83.

As can be seen from the schematic diagram of FIG. 2, when the mode switch 83 is in the position shown in the drawing, the points 27 and 31 of the magneto 11 function to control the discharging of the primary coil 23. Since the timing of the opening and closing of the magneto points 27 and 31 is controlled by the crankshaft 65 as illustrated in FIG. 1, the timing or advance of the spark is fixed.

FIGS. 3A–3C are exemplary timing diagrams illustrating the relative timing of the distributor finger 47, "top-dead-center" of the piston and the spark event at one of the plugs associated with the piston. The diagram of FIG. 3A illustrates the switching window of the distributor finger 47 at each one of the terminals 51 of the distributor head 53. This switching window is a time period in which the spark event must occur. The dashed line passing through all three of the timing diagrams of FIGS. 3A–3C is the top-dead-center (TDC) position of the piston stroke. In its mechanical or "default" mode, the ignition system of the engine 67 is fixed at a static advance angle with respect to the TDC position of the piston as illustrated in FIG. 3B. In its electronic mode, the controller 77 controls the timing of the discharging of the primary coil 23. With respect to the TDC position of the piston, the spark event can be advanced over a wide range. As FIG. 4 illustrates, the timing can be advanced in the electronic mode without sacrificing the total spark energy as would occur in a conventional magneto.

When the controller 77 of FIG. 2 energizes the mode switch 83, the relay action of the switch disconnects the primary coil 23 from the points 27 and 31 on one end and ground on the other and connects the primary coil to the controller 77 as illustrated. One end of the primary coil 23 is connected to the battery 81 of the electrical system. The other end of the primary coil 23 is connected to ground through a current regulator and switch 105. The mode switch 83 is mechanically biased in the position illustrated in FIG. 2 so that a loss of power from the electrical system de-energizes the relay of the mode switch, thereby defaulting the ignition system to a conventional magneto configuration.

By controlling the current through the primary coil 23, the controller 77 controls the total energy delivered to each of the plugs 17 for each spark event. By controlling the total energy and timing of the spark event, the controller 77 provides for increased efficiency of the engine 67 by advancing or retarding the spark in accordance with changing engine parameters such as speed and manifold pressure as indicated in the illustrated embodiment.

In the illustrated embodiment, the switching of the ignition system between a conventional magneto mode and electronic mode presents a possibility of generating an unwanted ignition spark when the mode switch 83 is either energized or de-energized. This unwanted ignition spark may occur when the current in the primary coil 23 collapses during transition of the mode switch 83 from one state to the other. In order to prevent unwanted ignition sparks during a transition of the mode switch 83, the invention provides for encouraging arcing between the contacts 107 and 109 of the mode switch (see FIG. 2). In this connection, conventional arc suppression networks and circuitry are intentionally not employed. By encouraging arcing across the contacts 107 and 109 of the mode switch 83, a sudden collapse of the current through the primary coil 23 is avoided, thus effectively suppressing any substantial energy transfer to the secondary coil 24 that can generate a spark at the spark plugs 17. Because the mode switch 83 changes states relatively infrequently, the shortening of the life cycle of the mode switch caused by any arcing is insubstantial.

Figure 6:
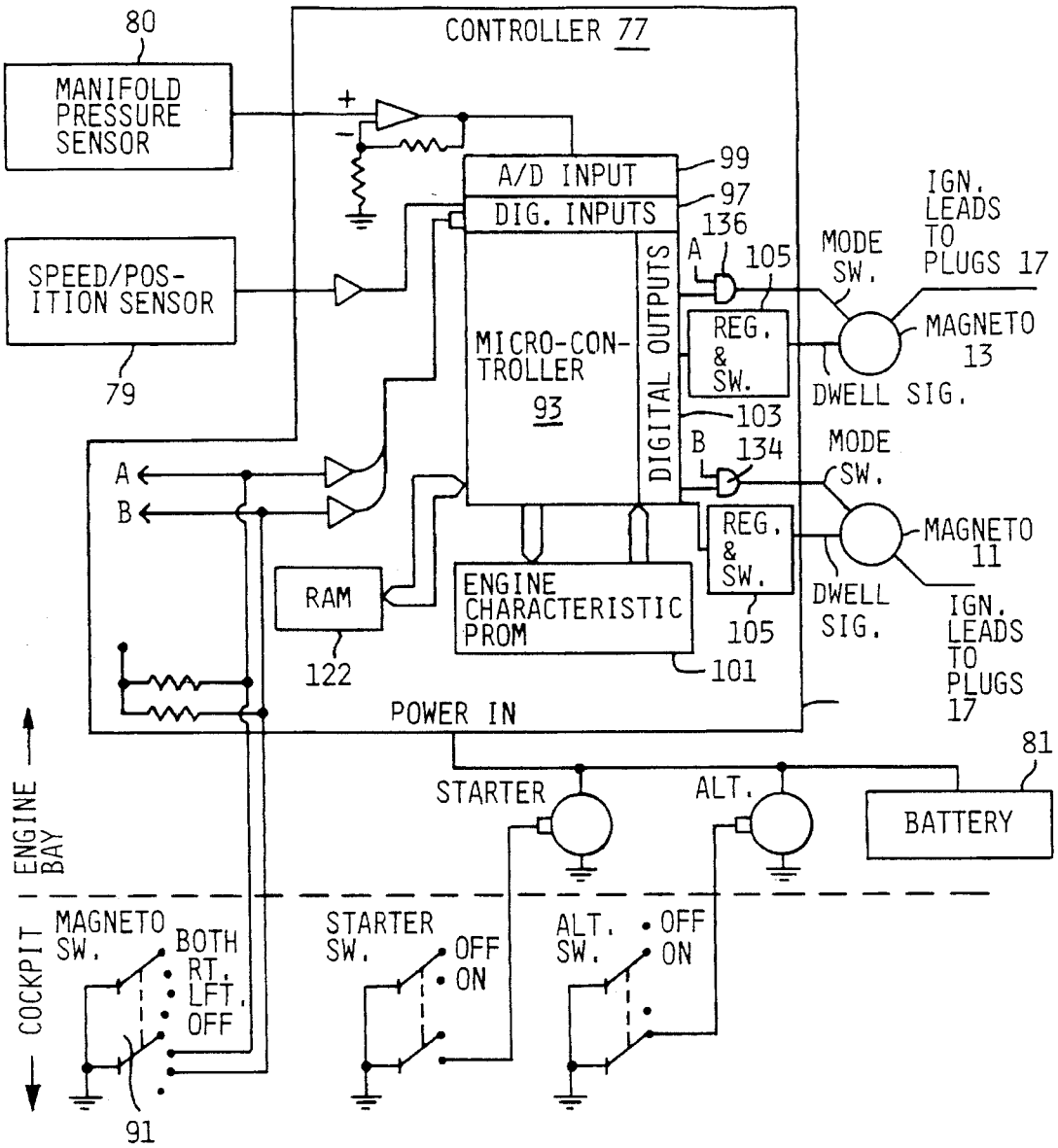
FIG. 6 is a functional schematic diagram of the electronic controller and sensor inputs to it that provide a status of engine parameters in response to which the controller advances or retards the timing of the spark event.

As illustrated in FIG. 6, the controller 77 includes a microcontroller or microprocessor 93. Preferably, the microprocessor is a 87C196KR manufactured by Intel Corporation of Santa Clara, Calif. The speed/position sensor 79 is preferably a Hall effect device 78 (see FIG. 13B) mounted proximate to a rotating blade 95 (see FIG. 13B) on the drive shaft 61. Rotation of the blade 95 with the drive shaft 61 induces a periodic signal in the Hall effect device 78 whose frequency is linearly proportional to the speed (rpm) of the engine 67. The instantaneous phase of the periodic signal is proportional to the instantaneous position of each piston 18 (see FIG. 2) in its reciprocating stroke (see the waveforms of FIGS. 9 and 11). As explained more fully hereinafter, this frequency and phase information is used by the controller 77 to control the frequency and absolute timing of the spark events so that each event occurs at the desired advance/retard angle with respect to the "top-dead-center" position of the associated piston 18.

The microcontroller 93 employs a down-counter (not shown) that counts down from the falling edge of the signal from the speed/position sensor 79 for the purpose of determining the timing of a "dwell" signal for delivering energy to the primary coil 23 of each of the magnetos 11 and 13. In this connection, from the signal from the speed/position sensor 79, the microcontroller 93 identifies $\Delta\Theta$/seconds, which allows the microcontroller to load the counter with an appropriate value, which is counted down to zero in order to demark the selected advance time for the ignition event. From the time period of dwell signal selected from the look-up table, the microcontroller 93 identifies a time prior to the ignition event to start energizing the primary coil 23 so that it contains the appropriate amount of energy when the time of the discharge event occurs. As described hereinafter, the "stop" time of the dwell signal corresponds to the time of the ignition event and the "start" time of the dwell signal corresponds to the lead signal time required to adequately charge the primary coil 23 to a desired energy level prior to the ignition event.

The signal from the speed/position sensor 79 is delivered to a digital input 97 for the microcontroller 93 as illustrated in FIG. 6. An analog signal from the manifold pressure sensor 80 is delivered to an analog-to-digital (A/D) converter 99 in FIG. 6 where the signal is converted to digital information that can be processed by the microcontroller 93. Other sensors (not shown) can also be provided as input signals to the microcontroller 93 for the purpose of resolving the operating condition of the engine 67. For example, temperature of the engine's head and its exhaust can provide information helpful to ensure the engine maintains highly efficient operation.

Figure 10:
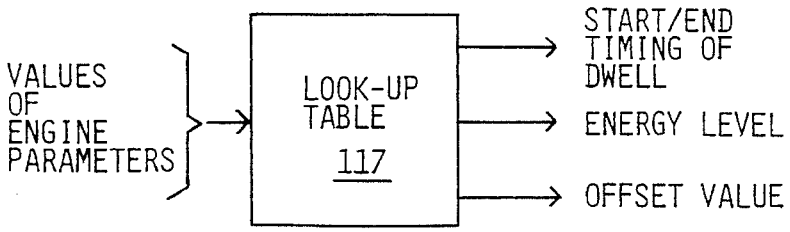
FIG. 10 is a schematic diagram of a look-up table of the electronic controller for converting values of engine operating parameters into ignition timing and energy level commands for delivery to the current regulator and switch of FIG. 7.

In accordance with another aspect of the invention, the engine status information derived from the sensors 79 and 81 is used by the microcontroller 93 under its program control to identify timing and energy information for each spark event. In the schematic diagram of FIG. 6, an engine characteristic PROM 101 includes a look-up table 117 (see FIG. 10) of timing and energy information for a spark event. The engine parameter information derived from the sensors 79 and 80 is used by the microcontroller 93 to identify specific timing and energy information in the look-up table, which is converted to a dwell signal for a spark event. The spark and energy information is output via digital outputs 103 as illustrated in FIG. 6 to each of the current regulators and switches 105. This data is delivered to the current regulator and switch 105 and converted to a dwell signal for controlling the energization level of the primary coil 23 and the timing of its discharging as discussed more fully hereinafter.

Figure 5A:
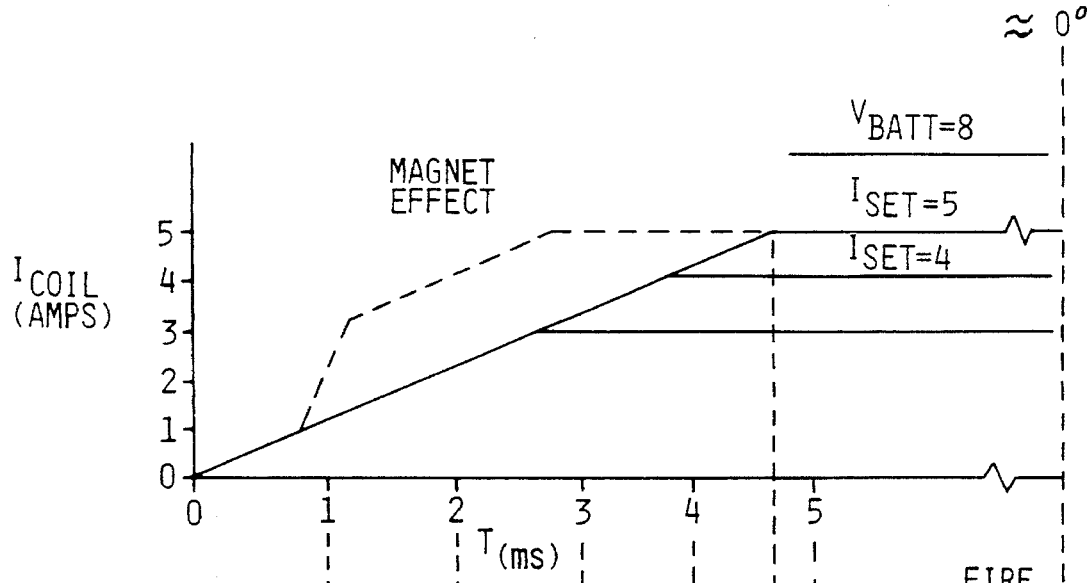
FIGS. 5A and 5B are exemplary waveforms of the current and voltage, respectively, at the primary coil of the ignition system for a charge/discharge cycle of the primary winding.
Figure 5B:
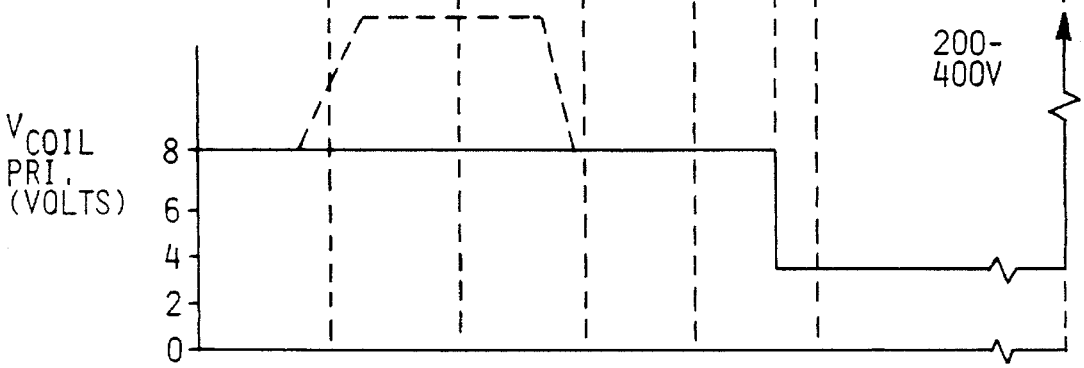

Referring to the current and voltage waveforms in FIGS. 5A and 5B, respectively, during start-up of the engine 67, the voltage at the battery 81 may be as low as approximately eight (8) volts for a nominal 12-volt battery. As illustrated in FIG. 5A, a typical charging cycle of the primary coil 23 during the start-up of the engine 67 ramps to a set voltage over a time period of several milliseconds. After the ramping current reaches a predetermined level that provides the desired energy for the present engine condition, the power transistor 107 of the current regulator and switch 105 is biased by the controller 77 to hold the current through the primary coil 23 at the desired level until the time of the discharge event as determined by the retard/advance data from the controller.

Figure 7:
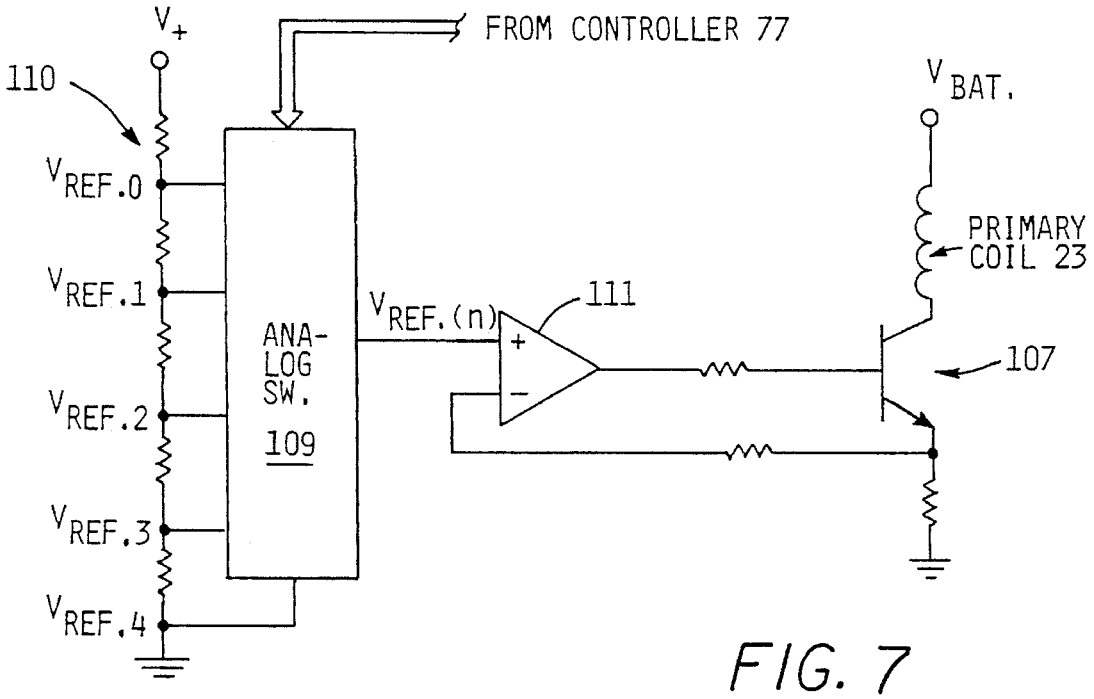
FIG. 7 is a functional block diagram of a current regulator and switch for advancing/retarding the spark event according to the invention, as well as controlling the total energy of the spark.

Referring to FIG. 7, the current regulator and switch 105 includes an analog switch 109 that is responsive to the controller 77 for selecting one of several reference voltages $V_{REF(n)}$ from a resistor ladder 110 to be output to an operational amplifier 111. The operational amplifier 111 provides the dwell signal, which drives the base of the power transistor 107. In response to the dwell signal, the power transistor 107 operates in its linear region in order to control the maximum current through the primary coil 23. Specifically, the operational amplifier 111 controls the base drive current to the power transistor 107 in order to maintain the voltage at the emitter of the power transistor 107 at the reference voltage $V_{REF(n)}$ selected by the controller 77. In order to discharge the energy from the primary coil 23, the power transistor 107 is turned off at the end time of the dwell signal, which causes an open circuit condition to discharge the energy stored in the primary coil 23 through the secondary coil 24 and into the plugs 17 by way of the distributor finger 47. To turn off the power transistor 107 at the end time of the dwell signal, the controller 77 selects the reference voltage $V_{REF(4)}$ which grounds the positive input of the operational amplifier 111. In turn, the power transistor 107 is turned off because the operational amplifier 111 no longer provides a base drive current to the transistor.

In the illustration of FIG. 5A, the end time of the dwell signal is at approximately "top-dead-center" of the piston 18 for purposes of providing the best timing for start-up of the engine 67. As suggested by the voltage waveform in FIG. 5B, the voltage across the primary coil 23 substantially decreases when the energy in the coil reaches its rated amount. The decreased voltage reflects the current regulator and switch 105 terminating the ramping of the current and total energy at the primary coil 23 and initiating a maintenance of the total energy at a desired level reflected by the value of the reference voltage $V_{REF(n)}$ delivered to the operational amplifier 111.

As indicated in FIGS. 5A and 5B, the current and voltage waveforms illustrated in the figures are idealized and do not reflect the added effects of the energy coupled into the primary coil 23 by the rotating magnet 63. The dashed lines associated with the current and voltage waveforms in FIGS. 5A and 5B are intended to represent the effects on the current and voltage at the primary coil 23 from the rotating magnet 63. As the dashed line in the current waveform suggests, if the energy boost from the rotating magnet 63 results in the total current reaching the predetermined level for the desired total energy, the controller 77 simply commands the current regulator and switch 105 to convert to an energy maintenance mode at an earlier time in the charging cycle.

In keeping with the invention, the current regulator and switch 105 under the control of the controller 77 increases the energy stored in the primary coil 23 during start-up in order to provide for easier starting of the engine, particularly in severe ambient conditions (e.g., extreme weather) or when one or more of the spark plugs 17 is difficult to fire because of fouling problems.

Figure 8:
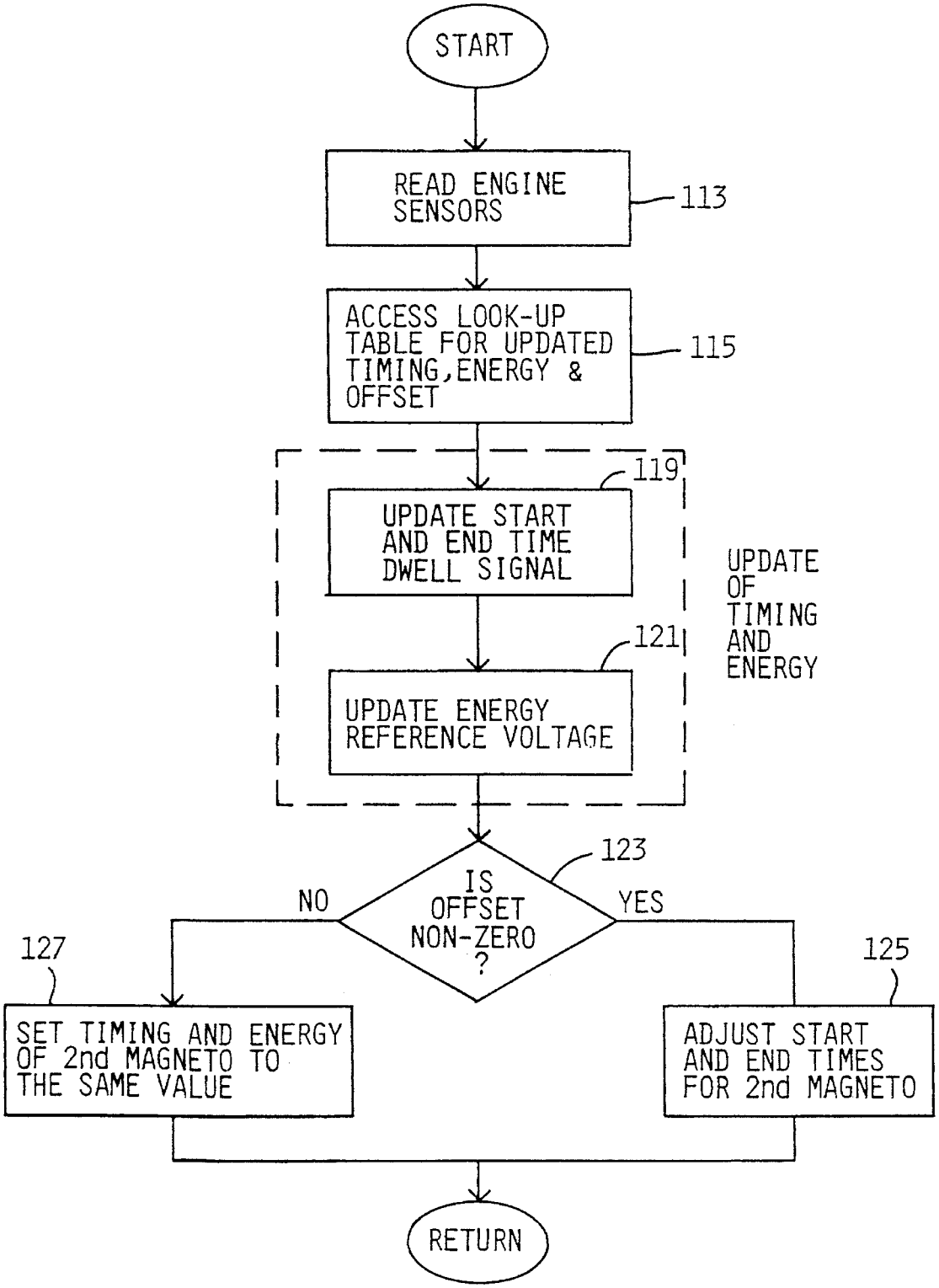
FIG. 8 is a flow diagram illustrating the steps executed by the electronic controller of FIG. 6 in order to update the timing and energy level of the spark event.

Approximately every one millisecond, the microcontroller 93 executes the steps illustrated in FIG. 8 in order to update the timing and energy of the spark event for each of the magnetos 11 and 13. At step 113, the microcontroller 93 reads the speed of the engine as derived from the speed/position sensor 79 by way of the digital inputs 97 and also reads the manifold pressure sensor 80 at the A/D input 99. At step 115, the microcontroller 93 accesses a look-up table 117 (see FIG. 10), which translates the values of the engine speed and the manifold pressure into start and end times for the dwell signal to the primary coil 23 and a total energy level for the spark event (i.e., $V_{ref(n)}$ of the analog switch 107).

At steps 119 and 121 at FIG. 8, the microcontroller 93 stores the updated dwell signal and energy value for the spark event in an appropriate register location such as a RAM 122 (see FIG. 6). At step 123, the microcontroller 93 determines whether the updated dwell signal and energy level includes an offset value for staggering the ignition events of the two magnetos 11 and 13. If the value of the offset is non-zero, the microcontroller 93 branches to step 125 and incrementally adjusts the timing of the dwell signal and/or its energy level for the second magneto 13. Otherwise, the microcontroller 93 branches to step 127 and records the updated timing and/or energy level of the dwell signal for magneto 13 as the same values as recorded for magneto 11 in steps 119 and 121. Like the updated values for the magneto 11, the updated values for the magneto 13 identified in either steps 125 or 127 are stored in a register or a memory such as RAM 122 in FIG. 6. After either step 125 or 127 are executed, the microcontroller 93 returns to other tasks or background operation until the remaining portion of the one millisecond allocation is complete, at which time the steps of FIG. 8 are again executed.

The important timing parameters of the ignition system according to the invention can be appreciated with reference to the exemplary and idealized waveforms in FIG. 9. Waveform (a) is a representation of the voltage appearing across the primary coil 23 in response to the changing magnetic field of the rotating magnet 63. In this regard, in a conventional magneto, the rotating magnet 63 has two poles so that each ignition event alternates between positive and negative peaks of the energy stored in the primary coil 23. In keeping with the invention, however, the energy imparted to the primary coil 23 by the battery 81 complements the energy imparted to the coil by the rotating magnet 63 only during the positive portions of the oscillating energy cycle of waveform (a). Therefore, the number of poles of the magnet 63 is selected in the illustrated embodiment so that the top-dead-center positions for each of the pistons 18 of the engine 67 as illustrated in waveform (c) of FIG. 9 are synchronized with the positive portions of the energy cycle of waveform (a). In effect, the invention doubles the number of poles on the rotating magnet 63 (relative to a conventional magneto) in order to double the frequency of the signal of waveform (a) in FIG. 9.

Waveform (b) of FIG. 9 illustrates the two signals derived from the speed/position and manifold pressure sensors 79 and 80, respectively. The manifold pressure sensor 80 provides a variable DC voltage that is periodically sampled by the A/D input 99 under control of the microcontroller 93 in FIG. 6. The speed/position sensor 79 is read by the digital inputs 97 in a conventional manner and converted to speed information by deriving the value of the period T between successive pulses–i.e., the speed is inversely proportional to the period T.

As described in connection with FIG. 8, after the microcontroller 93 samples the value of the signals from the sensors 79 and 80, an updated value for the start and end times of the dwell signal are calculated. In waveform (d) of FIG. 9, the dwell signal is illustrated as a square wave with the falling edge of the square wave corresponding to the "end time," at which the power transistor 107 is turned off by the controller 77. When the power transistor 107 is turned off, the primary coil 23 releases its energy through the secondary coil 24 into one of the spark plugs 17 by way of the distributor 53. Therefore, the selection of the end time of the dwell signal determines the value of the advance angle for the spark event. The start time of the dwell signal is determined by the microcontroller 93 to ensure that the energy in the coil 23 at the end time is at the value determined by the look-up table 117. If the energy level in the coil 23 reaches the desired level prior to the end time, the current regulator and switch 105 maintains the current through the power transistor 107 at a level corresponding to the selected reference voltage $V_{REF(n)}$ and the primary coil 23 until the end time is reached.

The precise makeup of the look-up table 117 is dependent upon empirical data gathered for the engine 67. For example, the empirical data may be collected using the following approach. First, performance criteria are selected. In one example, a single criterion of maximum torque is selected. Given the selected criteria or criterion, controllable parameters of the engine 67 are varied over the expected operating range of the engine in order to determine the approximate functional relationship between the controllable parameters and the selected criteria or criterion that is to be optimized. Depending on the complexity of this functional relationship, the amount of empirical data to be gathered is determined. Specifically, if the functional relationship is somewhat linear, the number of data points stored in the look-up table 117 can be less than if the functional relationship is substantially non-linear and wide ranging.

In any event, once the number of data points has been established, each of the engine parameters is varied in incremental steps while the others are held constant. At each setting of the parameters, the ignition advance angle, magneto coil energy and relative timing of the two magnetos 11 and 13 are adjusted in order to determine optimum performance of the engine 67 with respect to the selected criteria or criterion. The values for the advance angle, total magneto coil energy and relative timing of the two magnetos are placed into the look-up table 117. For example, for the illustrated embodiment the controllable parameters of the engine 67 used by the look-up table 117 are the speed/position sensors 79 and the manifold pressure sensor 80. In order to fill the look-up table 117, one of these parameters (i.e., speed/position or manifold pressure) is varied while the other is held constant. The parameter is varied in incremental steps over its operating range, where the size of the incremental steps is determined by the complexity of the relationship between the variable and the criteria or criterion which is to be optimized. With a sufficient number of data points entered into the look-up table 117, a simple linear interpolation algorithm can be used in order to derive the appropriate advance angle, total energy and relative timing data for all values of the signals from the speed/position sensor 79 and the manifold pressure sensor 80.

The controller 77 controls not only the current regulator and switch 105 and the mode switch 83 of the magneto 11 as illustrated, but it also controls a similar current regulator and switch 105 and a mode switch (not shown) of the second magneto 13. Because the hardware architecture of the ignition system of the invention provides for separate control of the two magnetos, the timing of the ignition event at each of the two plugs associated with a piston can be adjusted with respect to one another.

In keeping with the invention, the controller 77 coordinates the timing advance of the spark event for each of the two plugs associated with a common piston by electronically controlling the timing in each of the two magnetos 11 and 13 as illustrated. By staggering the initiation of the spark events for the two plugs of a piston, the duration of the total spark event can be effectively extended, thus providing an additional ability to control combustion of fuel in order to optimize performance of the engine 67. The precise nature of the staggering to extend the spark event and the engine conditions under which such staggering aids performance must be empirically determined.

Figure 11:
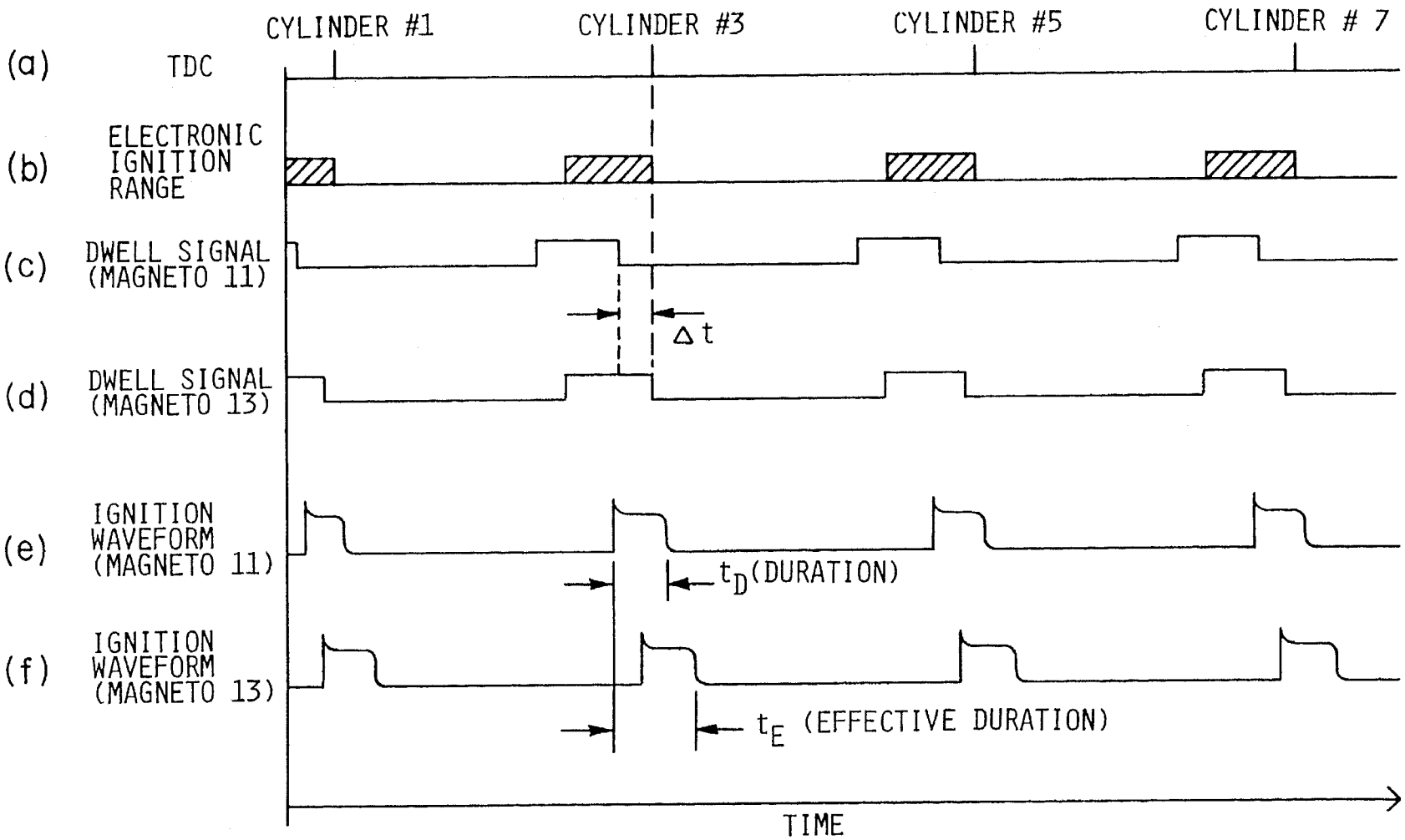
FIG. 11 is a timing diagram including exemplary and idealized waveforms (a) through (f) which illustrate various waveforms and timing parameters for effectively extending the spark event according to the invention.

FIG. 11 illustrates waveforms (a) through (f), which show the timing considerations for providing an extended ignition by staggering the timing of the dwell signals of the magnetos 11 and 13 according to the invention. Waveform (a) indicates the time markings for successive ones of the pistons 18 of the engine 67 reaching the "top-dead-center" position. As is well known in the art, the timing of the ignition events must be synchronized to the timing of the reciprocating movement of the pistons 18 in each of the cylinders. In waveform (b) of FIG. 11, the range of electronic ignition provided by the controller 77 is illustrated as extending from the "top-dead-center" position or zero degrees to approximately a 50 degree advance angle.

Waveforms (c) and (d) of FIG. 11 illustrate the dwell signals for magnetos 11 and 13, respectively. As can be seen by comparing the two waveforms (c) and (d), the dwell signal for the magneto 11 is advanced by a time $\Delta t$ relative to the dwell signal for the magneto 13. In the timing illustrated by the waveforms (a) through (f) of FIG. 11, the end time for the dwell signal of magneto 13 coincides with the "top-dead-center" position of the cylinders of the engine 67. The end time of the dwell signal for the magneto 11 is advanced by the time $\Delta t$, which corresponds to a mechanical angle determined by the speed of the crankshaft 65 as previously explained.

Waveforms (e) and (f) are idealized current waveforms for the spark event at the spark plugs 17. Each of the dwell signals of waveforms (c) and (d) for magnetos 11 and 13, respectively, is of the same duration and magnitude, meaning that the energy for the spark event in each of the magnetos is set at the same value. Because the dwell signals of the magnetos 11 and 13 for the spark plugs 17 of a common cylinder are offset, the current waveforms (e) and (f) are correspondingly offset by the same time period $\Delta t$. Therefore, the effective duration of the spark event in the cylinder is the duration of the current waveform $t_D$ as indicated in waveform (e) plus the offset time $\Delta t$ (i.e., $t_E=t_D+\Delta t$).

Another important aspect of the invention is the ability of the pilot in an aircraft application of the ignition system to satisfactorily complete existing U.S. Federal Aviation Administration (FAA) pre-flight testing requirements of the magnetos 11 and 13 without requiring FAA modification of those requirements if the engine 67 includes an ignition system according to the invention. Referring to FIG. 6, the cockpit of an aircraft includes a standard four-position magneto switch 91 used by a pilot to test the dual magnetos 11 and 13 prior to flight. Specifically, the four-position switch 91 includes a position for operating the "left" magneto 13, the "right" magneto 11 and a third position for operating both magnetos, which is the normal operating position. A fourth position is an off position.

Those familiar with these types of switches will appreciate that they vary in design. Some are as illustrated, others have five (5) positions or may distribute the switching function to more than one switch. As the term is used herein, "switch assembly" means ganged or separate switches for controlling the magnetos 11 and 13.

In accordance with existing FAA requirements, the controller 77 is responsive to the position of the switch assembly (i.e., switch 91 in FIG. 6) so as to de-energize the mode switch 83 when the pilot switches the magneto switch assembly 91 to either the "left" or "right" magneto positions. The controller 77 energizes the mode switch 83 and returns the ignition system to an electronic control of the spark advance after a predetermined time period when the controller senses the pilot has returned the magneto switch assembly 91 to the position for operating both magnetos 11 and 13.

In the illustrated embodiment as shown in FIG. 6, the controller 77 utilizes hardware responsive to the position of the switch assembly 91 in order to place the magnetos 11 and 13 in their mechanical modes. Logic gates 134 and 136 function to selectively disable the mode switch 83 for each of the magnetos 11 and 13 by blocking command signals from the microcontroller 93 when the switch assembly 91 is in its "left" or "right" magneto position.

Figure 12:
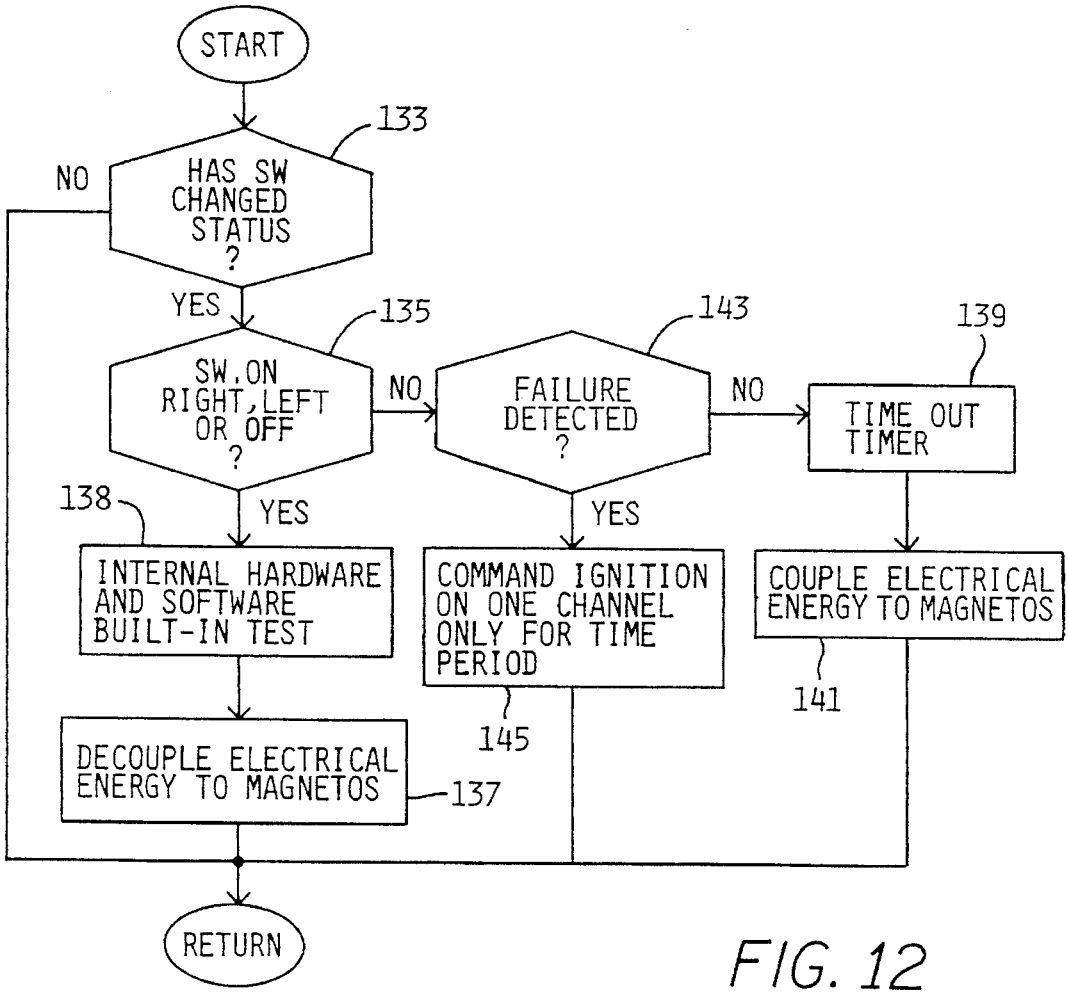
FIG. 12 is a flow diagram illustrating the steps executed by the electronic controller of FIG. 6 in order to provide a user interface for controlling the ignition system of the invention that is the same as the interface of conventional magneto-based ignition systems for aircraft applications and which is also in accordance with existing pre-flight testing protocols required by regulatory agencies (e.g., U.S. Federal Aviation Administration)

In keeping with the invention, the microcontroller 93 monitors the status of the magneto switch assembly 91 (see FIG. 6) in order to ensure that the ignition system of the invention operates in a manner consisting with existing regulatory requirements, thus making the ignition system readily adaptable to existing re-flight testing protocol in aircraft applications. The microcontroller 93 executes the steps illustrated in the flow diagram of FIG. 12 either periodically or in accordance with an interrupt-driven routine. In either case, the microcontroller 93 determines in step 133 whether a change has occurred in the position of the magneto switch 91. If no change in the position of the switch 91 has occurred since the last interrogation of the switch, the microcontroller 93 immediately returns to background tasks as indicated. On the other hand, if a change in status of the switch 91 is detected in step 133, the microcontroller 93 branches to step 135 in order to determine the present status of the switch 91.

If the switch 91 is at either the "right," "left" or "off" positions, the microcontroller 93 retains its command of power to transistor 107 for each of the magnetos 11 and 13. However, the mode of the ignition system is controlled independently of the microcontroller 93 as indicated in FIG. 6. In this connection, the existing regulatory requirements of the U.S. Federal Aviation Administration require a pre-flight testing protocol for aircraft having internal combustion engines. The protocol requires the pilot to test each of the magnetos 11 and 13 separately. As part of the testing protocol, the magnetos are to be tested in their mechanical mode of operation. Therefore, the controller 77 senses the position of the switch 91 and releases the mode switch 83 in each of the magnetos 11 and 13 in step 137. Moreover, in step 138, the microcontroller 93 conducts an internal check of its operation as well as a check of the associated hardware of the controller 77 and other hardware of the ignition system. If an anomaly is identified, a flag is set.

If the switch 91 is not in its "right," "left" or "off" position, it then must be in the "both" position, meaning that the magnetos 11 and 13 are set for normal flight operation. In response to its sensing the position of the magneto switch 91 in the "both" position, the microcontroller 93 branches to step 139 wherein an internal timer (not shown) is timed out before the mode switch 83 is re-energized in step 141. However, when the microcontroller 93 senses the switch 91 has been moved to the "BOTH" position for the first time after startup of the engine 67, the microcontroller checks at step 143 to determine if a flag has been set from the execution of step 138. If the flag is set, a malfunction is assumed and the controller 77 branches to step 145. At step 145, the microcontroller 93 delivers dwell signals to only one of the magnetos 11 and 13 with the intent to signal the pilot that a malfunction has been detected by intentionally lowering the rpm of the engine 67 during the pre-flight testing. Obviously, steps 143 and 145 are only executed in connection with pre-flight testing. If the microcontroller 93 senses a change in the status of the switch 91 during flight conditions, step 145 is not executed.

Figure 14:
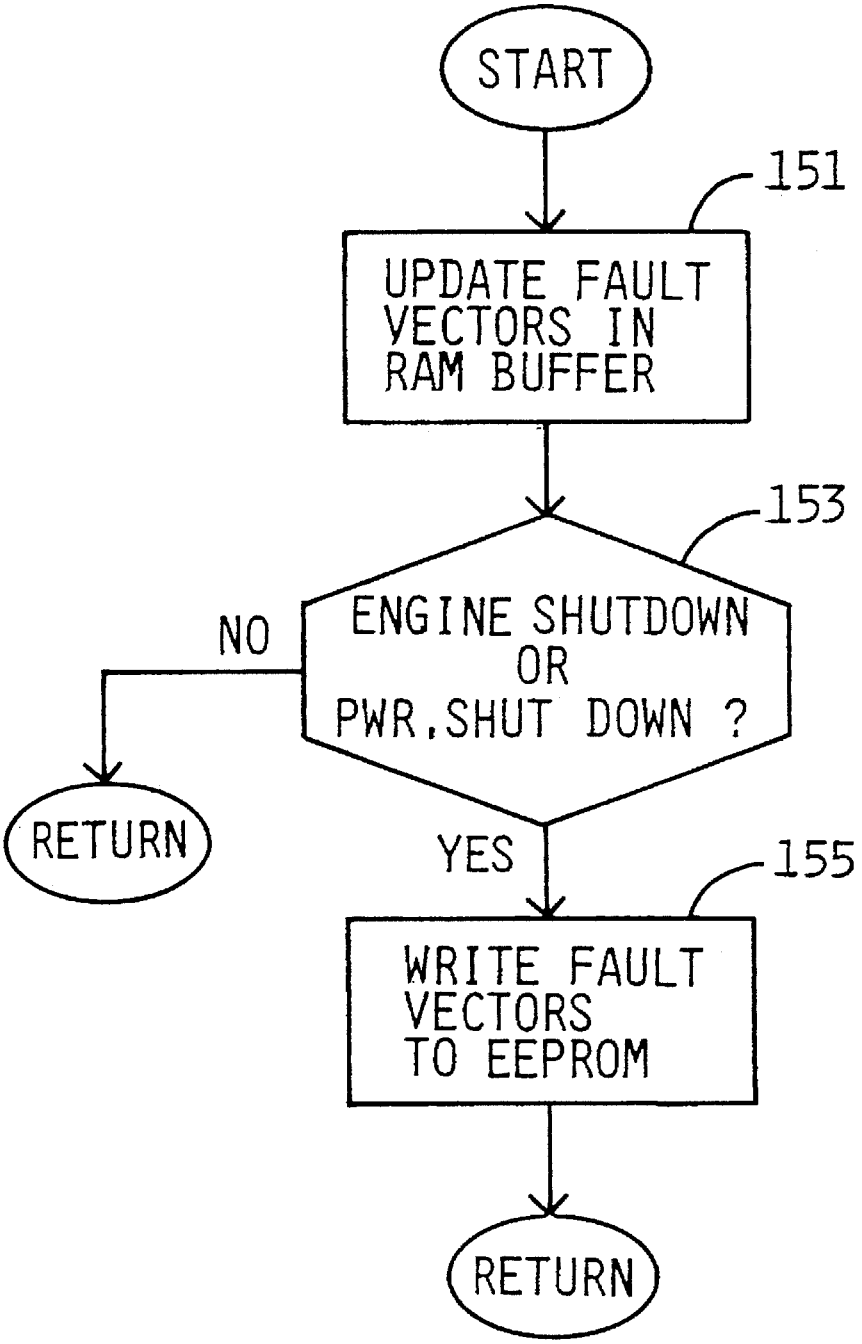
FIG. 14 is a flow diagram of an exemplary diagnostics routine for identifying and recording failures of the ignition system and/or engine.

In accordance with another aspect of the invention, the controller 77 executes a diagnostic routine such as the exemplary routine illustrated in FIG. 14. In step 151 of the routine, the controller checks the status of the values of sensors such as the speed/position sensor 79 and the manifold pressure sensor 80. If the sensors indicate an abnormal condition, the values of the sensors are time and date stamped and stored in RAM 122. Also, the contemporaneous operating conditions of the ignition system are also stored in the RAM 122. For example, the start and end times and the energy level of the dwell signal for each of the magnetos 11 and 13 may be stored in the RAM.

Additional information regarding the status of the ignition system can be monitored and recorded in keeping with this aspect of the invention. For example, the current through the power transistor 107 can be sensed by an analog device, converted to a digital signal by the A/D input 99 and recorder in the RAM 122. The current levels could be recorded periodically with only the most recent readings kept. Alternatively, the readings could be compared to criteria for reporting only anomalies. However the data is collected, it is transferred to an EEPROM (not shown) in step 155 if the controller 77 senses a shutdown of the engine 67 or a loss of electrical power in step 153. In this manner, the status of the ignition system and engine immediately prior to a failure of the electrical system can be saved in the EEPROM for later downloading and evaluation.

Finally, alternative embodiments of the invention include the incorporation of a dual-mode magneto as described herein in combination with a fully electronic ignition system such as is conventionally used for automotive internal combustion engines. In this regard, the dual-mode magneto based ignition system fires one of two spark plugs associated with each piston. The other spark plug is controlled by the conventional electronic ignition system powered by a battery source. Failure of the battery-based electrical system will result in the failure of the conventional automotive ignition system, but the dual-mode, magneto-based ignition system will switch to its mechanical timing mode in accordance with the invention and, therefore, provide the fail-safe redundancy necessary for aircraft applications. Of course, in some industrial applications the redundancy of dual ignition systems may not be necessary. In these situations, a single magneto-based ignition system according to the invention may be employed. In general, the invention contemplates a single, dual mode, magneto-based ignition system according to the invention either as the sole source of ignition or as one of two ignition systems in a dual or redundant ignition system such as illustrated in FIG. 1, with the second ignition system also being according to the invention or, alternatively, being any conventional ignition system.

From the foregoing it can be seen that the ignition system illustrated in FIGS. 1–14 provides for improved performance of the engine 67 while maintaining the essential fail-safe characteristics of conventional magnetos in aircraft applications. Using various sensors such as the speed/position sensor 79 and the manifold pressure sensor 80, which provide information indicative of the operating status of the engine 67, the ignition system can dynamically adjust the timing and energy of the spark events in order to ensure that the engine 67 operates at close to optimum performance throughout the entirety of a flight—i.e., from take-off to landing. In this connection, those skilled in the art of ignition systems and engines for aircraft will appreciate that the precise response characteristics of the ignition system to changes in the values of various parameters sensed by any embodiment of the ignition system according to the invention will be at least partially dependent on the particular characteristics of the engine and, therefore, may be dependent upon a database of empirically gathered information regarding the operating characteristics of the engine.

We claim:

1. An ignition system for an internal combustion engine comprising a magneto driven by the engine for delivering energy to a primary coil of the magneto, a secondary winding of the magneto for coupling energy stored in the primary coil to a spark plug for generating an ignition spark, a source of energy for delivering power to the primary coil independent of engine position and speed, at least one breaker mechanically responsive to the position and speed of the engine for controlling a discharging of energy stored in the primary coil into the plug by way of the secondary coil, a timing switch responsive to an electronic controller for controlling the discharging of energy stored in the primary coil into the plug by way of the secondary coil, and a mode switch for normally selecting the timing switch for controlling the discharging of energy stored in the primary and alternatively for selecting the at least one breaker for controlling the discharging of the energy stored in the primary coil when there is a failure of the electronic controller.

2. The ignition system as set forth in claim 1 wherein each piston of the internal combustion engine is associated with two spark plugs and the electronic controller includes means for staggering the timing of the ignition spark at each plug in order to extend the maintenance of a spark for combustion of fuel.

3. The ignition system as set forth in claim 1 including a sensor for sensing an operating condition of the engine and providing a signal whose values are indicative of the operating condition of the engine, the controller including means responsive to the changes in the values of the signal from the sensor for controlling the timing switch to adjust the timing of the discharging of energy into the plug.

4. The ignition system as set forth in claim 3 wherein the controller includes diagnostic means for sensing an anomaly in the values of the signal from the sensor and recording the anomaly in a memory.

5. The ignition system as set forth in claim 1 wherein the mode switch includes opposing contacts that encourage arcing between them when the mode switch is opened, thereby suppressing ignition by inhibiting the transfer of energy from the primary coil to the secondary coil when the mode switch changes states.

6. The ignition system as set forth in claim 1 wherein the magneto includes a rotating magnet that imparts energy to the primary coil characterized by a voltage alternating between positive and negative values and a circuit for controlling the connection of the independent source of energy to the primary coil in order to impart the energy from the source to the primary coil in alternating positive and negative voltage values that are synchronized with the alternating positive and negative voltage imparted to the primary coil by the rotating magnet.

7. The ignition system as set forth in claim 3 wherein the means responsive to changes in the values of the signals from the sensor includes a look-up table for translating the value of the signal to start and end times for turning on and off the timing switch.

8. The ignition system as set forth in claim 3 wherein the controller includes means responsive to changes in the values of the signal from the sensor for regulating a total energy stored in the primary coil.

9. The ignition system as set forth in claim 1 wherein the magneto includes a rotating magnet that imparts energy to the primary coil characterized by a voltage alternating between positive and negative values and means for synchronizing a top-dead-center position of each piston of the engine with the positive voltage at the primary coil.

10. An ignition system for an engine of an aircraft comprising: first and second magnetos, each having primary and secondary coils and a rotating magnet driven by the engine for imparting energy to the primary coil, each of the magnetos providing energy to one of two spark plugs associated with each piston of the engine, and an electronic controller for controlling the discharge of the energy in the primary coil of each of the magnetos in order to generate a spark at each of the two spark plugs.

11. The ignition system as set forth in claim 10 including a sensor for sensing an operating condition of the engine and providing a signal whose values are indicative of the operating condition of the engine, the controller including diagnostic means for sensing anomalies in the values of the signal from the sensor and recording the anomalies in a memory.

12. The ignition system as set forth in claim 10 wherein the electronic controller includes means for adjusting during operation the timing of energy discharge of each of the magnetos independent of the other so as to stagger the spark events of the two spark plugs in order to effectively combust fuel in a combustion chamber common to the two spark plugs.

13. The ignition system as set forth in claim 10 including a mode switch for connecting the primary coil of at least one of the first and second magnetos to a current regulator and switch in one position of the mode switch and for connecting the primary coil of the at least one magneto to a set of breaker points driven by the engine in a second position of the mode switch.

14. The ignition system as set forth in claim 13 wherein the controller contains means for biasing the mode switch in its first position and means for providing energy to the primary coil that supplements and complements the energy imparted to the primary coil by the rotating magnet.

15. The ignition system as set forth in claim 14 including means for placing the mode switch in its second position in response to a failure of the energy source.

16. The ignition system as set forth in claim 10 including a sensor for sensing a value of an operating parameter of the engine of the aircraft and the controller including means responsive to a change in value for adjusting the timing of the discharging of the energy in the primary coil of each magneto.

17. An ignition system for an engine of an aircraft comprising: first and second magnetos, each having primary and secondary coils, and a rotating magnet driven by the engine for imparting energy to the primary coil, a source of energy to the primary coil of each of the magnetos independent of the rotating magnet, a mode switch for selectively providing the energy from the rotating magnet and the independent source to the primary coil of each of the two magnetos, a switch assembly in a cockpit of the aircraft having a first position for activating the first magneto for providing ignition, a second position of the switch assembly for activating the second magneto for providing ignition, and a third position of the assembly for activating both the first and second magnetos for providing ignition, and a means responsive to the cockpit switch assembly for controlling the mode switch to provide only the energy from the rotating magnet to the primary coil of the respective one of the magnetos when the cockpit switch assembly is in its first and second positions.

18. The ignition system as set forth in claim 17 wherein the controller includes means for sensing the cockpit switch assembly in the third position and controlling the mode switch to provide energy to the primary coil from both the rotating magnet and the independent source for each of the two magnetos.

19. The ignition system as set forth in claim 18 including a current regulator and switch in a series connection with the primary coil of each of the two magnetos and the current regulator and switch being responsive to the controller for controlling the total energy imparted to the primary coil and the timing of the discharge of the total energy into the secondary coil, which creates an ignition event.

20. The ignition system as set forth in claim 19 wherein the mode switch is responsive to a failure of the electrical system or of the controller itself to disable the current regulator and mode switch and enable breaker points mechanically driven by the engine for the purpose of controlling the discharging of the primary coil into the secondary coil.

* * * * *